United States Patent [19]

Juillard

[11] Patent Number: 4,460,020

[45] Date of Patent: Jul. 17, 1984

[54] DEVICE FOR ACTUATING HEDDLE FRAMES IN WEAVING LOOMS

[75] Inventor: Yves Juillard, Mulhouse, France

[73] Assignee: Societe Alsacienne de Constructions Mecaniques de Mulhouse, Mulhouse Cedex, France

[21] Appl. No.: 373,123

[22] Filed: Apr. 29, 1982

[30] Foreign Application Priority Data

May 12, 1981 [FR] France ..... 81 09397

[51] Int. Cl.[3] ..... D03C 13/00

[52] U.S. Cl. ..... 139/82; 139/57

[58] Field of Search ..... 139/82, 80, 81, 56, 139/57, 58, 33

[56] References Cited

U.S. PATENT DOCUMENTS

| | | | |
|---|---|---|---|
| 4,083,385 | 4/1978 | Pfarrwaller | 139/57 |

FOREIGN PATENT DOCUMENTS

| | | | |
|---|---|---|---|
| 3021163 | 4/1981 | Fed. Rep. of Germany | 139/82 |
| 907831 | 7/1945 | France | 139/58 |
| 2477186 | 9/1981 | France | 139/57 |
| 96643 | 11/1922 | Switzerland | 139/33 |
| 629929 | 12/1981 | Switzerland | 139/82 |

*Primary Examiner*—James Kee Chi

*Attorney, Agent, or Firm*—J. David Dainow

[57] ABSTRACT

Each odd-numbered heddle frame is actuated by a pair of rockers mounted on two horizontal axes. Each even-numbered heddle frame is actuated by a pair of rockers which are mounted on two other horizontal axes. The resultant increase in the pitch between rockers on one and the same axis permits the use of the actuating device for heddle frames of small thickness.

11 Claims, 4 Drawing Figures

DEVICE FOR ACTUATING HEDDLE FRAMES IN WEAVING LOOMS

BACKGROUND OF THE INVENTION

This invention relates to the textile industry and more particularly to the field of weaving.

It is known that, in all types of weaving looms, the warp threads released from the warp beam are supported by a roller having the design function of subjecting the threads to a predetermined tension. At the exit of this thread support roller, the warp threads are divided into two layers which form the shed in which the weft threads are inserted. The two layers are obtained by passing the warp threads through the heddle eyelets carried by frames driven by means of a shedding mechanism in reciprocating motion substantially in a vertical plane. The number of heddle frames as well as the sequence of displacement of these latter depend on the construction of the fabric being produced.

The shedding mechanism is coupled to the heddle frames by means of two-arm levers or so-called rockers which are capable of displacement in oscillating motion about a substantially horizontal axis. One rocker arm is rigidly fixed to a rod connected to the shedding mechanism and the other rocker arm carries a link-arm which is attached to the heddle frame.

Since each frame is usually actuated by two corresponding rockers placed respectively on the right-hand side and on the left-hand side of the frame, all the corresponding rockers of all the frames such as the right-hand rockers, for example, are mounted on a common horizontal axis while all the other corresponding rockers are mounted on a second common horizontal axis. The "pitch" of the rockers on one and the same axis is therefore equal to the "pitch" of the frames.

Heddle frames in current use have a thickness of 12 millimeters. The space thus made available for each rocker is consequently sufficient in particular to accommodate an antifriction bearing on which the rocker is pivotally mounted.

As the beating-up rate of weaving looms increases, so it becomes essential to reduce the weight of moving parts. A considerable gain in weight of the harness is obtained by reducing the thickness of the frames. At the present time, frames having a thickness of 7 millimeters are commercially available. The result of this smaller thickness is that the operating pitch is considerably reduced, that in particular the surfaces which are in contact during the oscillating motion of the rockers are of very small width and are subject to wear at a higher rate as the motion takes place at a higher speed, and that there is not sufficient space to provide for an antifriction bearing.

SUMMARY OF THE INVENTION

The object of the present invention is to utilize heddle frames of small thickness while preventing rapid wear of contacting surfaces during the oscillating motion of the rockers. The invention accordingly relates to a heddleframe actuating system for weaving looms in which each frame is provided with one pair of rockers which are capable of oscillating motion under the action of the shedding mechanism. The invention is distinguished by the fact that each series of rockers is split-up into a group corresponding to the even-numbered frames and into another group corresponding to the odd-numbered frames which are so arranged that the rods connected to the shedding mechanism pass between the link-arms which serve to couple two adjacent frames together.

The features and advantages of the invention will be more apparent to those skilled in the art upon consideration of the following description and accompanying drawings, wherein:

DESCRIPTION OF THE PREFERRED EMBODIMENT

Figure 1:
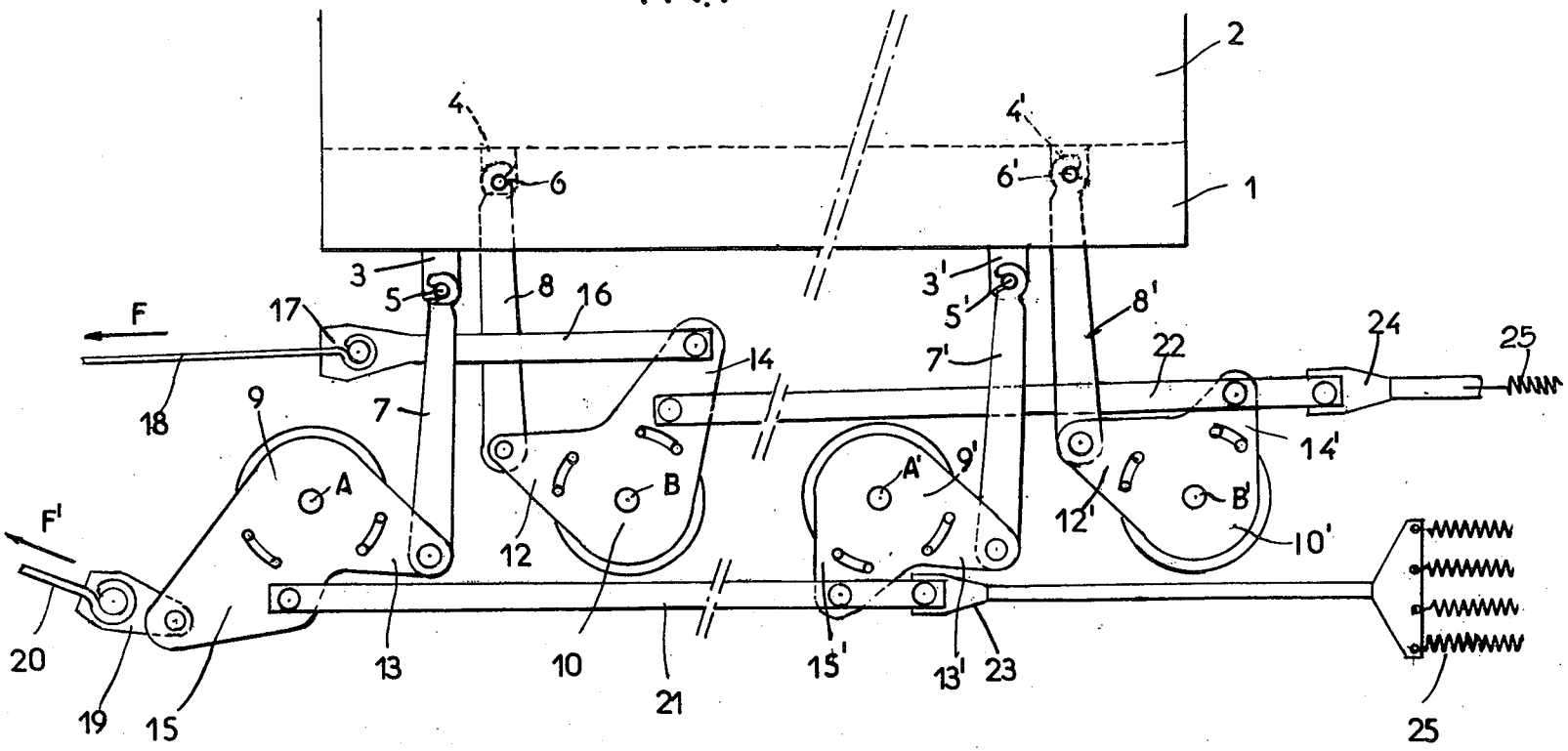
FIG. 1 is a front view of a frame-actuating system in accordance with the invention.

There are shown in FIG. 1 two consecutive side-by-side frames 1 and 2 which will be referred-to respectively as the odd frame and the even frame. Each frame is provided at the lower end with two lugs designated respectively by the references 3,3' and 4,4'. Each lug is adapted to carry a substantially horizontal stub-shaft 5,5', 6,6'. Each stub-shaft is adapted to receive the head of one of the link-arms 7,7', 8,8'. No further details need be given here in regard to the link-arms since they have already been fully described in French patent application No. 81 07581 filed on Apr. 15th, 1981 in respect of "A system for mounting harness frames in a weaving loom" in the name of the present Applicant. It is apparent that this system for coupling harness or heddle frames is given solely by way of example and that any other suitable means may be employed without thereby departing from the scope of the invention.

Figure 3:
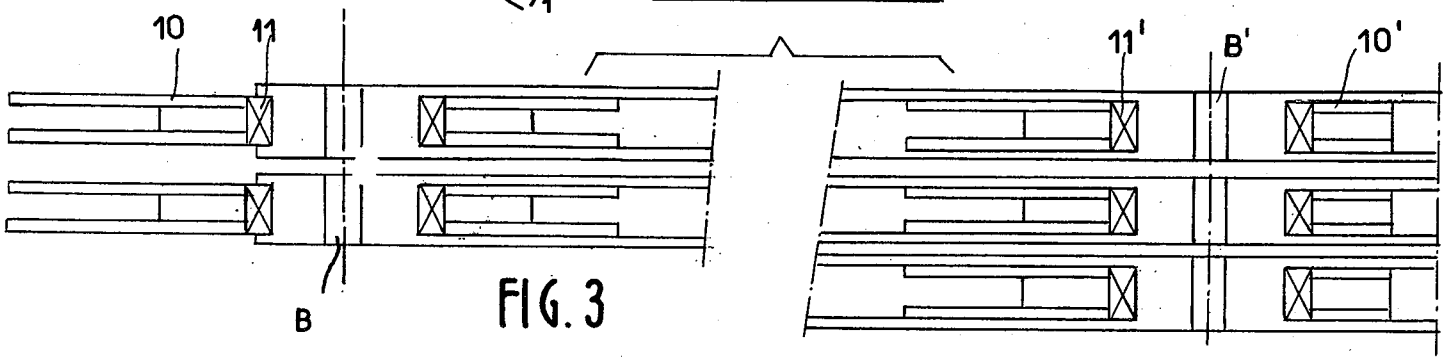
FIG. 3 shows the arrangement of the rockers.

The end of each link-arm is associated with a rocker 9,9', 10,10'. Each rocker is mounted for pivotal displacement about a substantially horizontal axis A-A'-B-B' by means of antifriction bearings such as those designated by the reference 11,11' in FIG. 3. Each rocker has the shape of a bell-crank lever, one of the link-arms 7,7',8'8' mentioned above being pivotally mounted on one of the two arms of said bell-crank lever. The other arm 14,15 of the rockers 9,10 which are located on the same side of the heddle frames 1,2 is pivotally attached to a rod or second connecting means 16 provided with an enlarged end portion 17 to which is attached a cable or first correcting means 18. Said cable can be pulled in the direction indicated by the arrow F by means of the shedding mechanism (not shown in the drawings). The rod and its enlarged end portion can be replaced by a strap-link 19 on which is fixed a cable 20 and this latter can be pulled in the direction of the arrow F' by the shedding mechanism.

The pairs of rockers 9,9' and 10,10' which are associated with one and the same heddle frame are rigidly coupled by means of a rod 21,22. One end of each rod terminates in a coupling member 23,24, the function of which is to connect said rods with a system of springs 25 attached to a stationary portion of the weaving loom (not shown in the drawings); the springs to which coupling member 24 is connected also are not shown.

Figure 2:
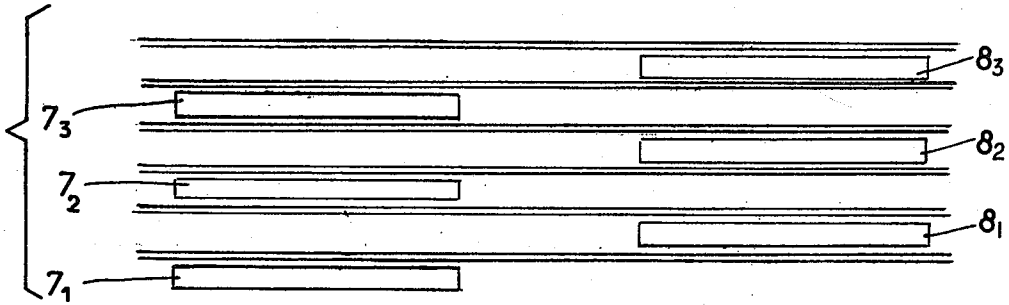
FIG. 2 is a top view of the arrangement of the frame-supporting link-arms with respect to the rods which are connected to the shedding mechanism.

Each pair of heddle frames is equipped with an actuating mechanism of the type hereinabove described. The arrangement in which the rockers associated with the corresponding link-arms of all the heddle frames are not mounted on a single shaft but are split-up into two sets has the effect of increasing the pitch of this rocker system to a fairly high value in order to permit the use of antifriction bearings as in the case of assemblies in which the heddle frames are of greater width. FIG. 2 shows schematically how link arms $7_1$, $7_2$ and $7_3$, for a succession of odd-numbered heddle frames having alternate pitch, so that the rockers corresponding to these link arms have space on each side for suitable bearings. Link arms $8_1$, $8_2$ and $8_3$ in FIG. 2 are similarly spaced alternately to correspond with the even-numbered heddle frames.

The operation of the device takes place as follows: the shedding mechanism (not shown in the drawings) pulls the cable 18 in the direction of the arrow F. The rocker 10 is driven in rotation in the anticlockwise direction; the rocker arm 12 moves downwards and is accompanied by the link-arm 8. At the same time, the rocker 10' is driven in rotation in the same direction by reason of the rigid coupling provided by the rod 22. The arm 12' moves downwards and is accompanied both by the link-arm 8' and by the frame 2.

If the tractive force exerted on the cable 20 by the shedding mechanism is discontinued, the springs 25 return the rod 21 to the right-hand side of FIG. 1 and initiate a pivotal displacement of the rockers 9 and 9' in the anticlockwise direction. The arms 13 and 13' move upwards and exert an upward thrust on the link-arms 7 and 7' which in turn produce an upward displacement of the frame 1. When the next change of shed takes place, the shedding mechanism will draw the cable 20 in the direction of the arrow F'. The rocker 9 will rotate in the clockwise direction, thus drawing the link-arm 7 downwards. The rocker 9' will be subjected to the same movement by reason of the rigid connection provided by the rod 21 and the link-arm 7' will also be displaced downwards, thereby moving the frame 1 downwards to the bottom position. At the same time, a tractive force will no longer be exerted on the cable 18; the rockers 10 and 10' will rotate in the clockwise direction under the influence of the springs 25; and the link-arms 8 and 8' will cause the frame 2 to move upwards to the top position. For convenience the components coupling the shedding mechanism with the rockers and the springs will be called the drive mechanism which includes first and second drive means for the odd and even-numbered frames respectively.

Figure 4:
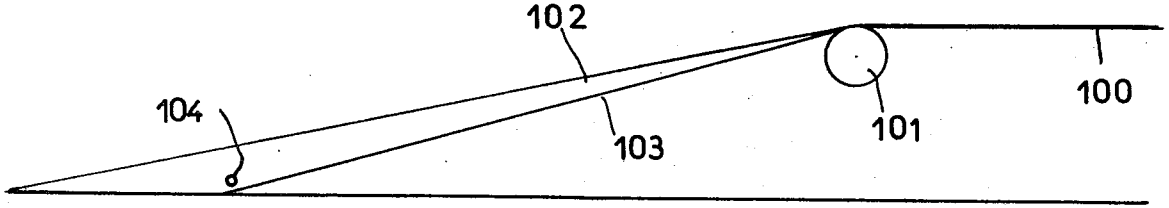
FIG. 4 illustrates a dissymmetrical shed.

It is worthy of note that the downward movement of the heddle frames is positively controlled by the tractive force exerted on the cables 18 or 20 by the shedding mechanism whereas the upward movement of said frames takes place under the action of restoring springs 25. This dissymmetry is explained by the fact that, in nearly all cases, weavers work with a shed having the configuration shown in FIG. 4. When they have been suitably tensioned by means of the roller 101, the warp threads 100 are divided into two layers 102 and 103 so as to form the shed in which the weft threads are inserted at 104. It is therefore very important to ensure high stability of the lower layer 103 since the weft inserter (neddles, projectile, and so on) bears on said lower layer. Stability is ensured if the downward movement of the heddle frames is carried out positively whereas this would not be the case if the downward movement were to take place under the action of springs which invariably give rise to vibrations, especially at high speeds.

What is claimed is:

1. In a weaving loom operable with a shedding mechanism, the loom including a plurality of heddle frames positioned side-by-side and numbered consecutively as odd and even numbered frames, a device for actuating said frames comprising: a row of at least four parallel support shafts extending transversely beneath said frames and numbered consecutively with odd and even numbers, a plurality of bellcrank rockers, each pivotally mounted on one of said shafts and similarly numbered, and a drive mechanism comprising first drive means coupling said rockers on said first and third shafts to said odd numbered frames, second drive means coupling said rockers on said second and fourth shafts to said even numbered frames, said first and second drive means being coupled to said shedding mechanism, whereby said frames are reciprocated upward and downward.

2. Apparatus according to claim 1 wherein the two rockers coupled to each frame comprise a pair of rockers each of said rockers has a pair of first and second arms, and each of said drive means comprises first connecting means coupling the shedding mechanism to the first arm of one rocker of a pair and second connecting means coupling the rockers of each pair to pivot similarly, said device further comprising a plurality of link arms, each link arm secured to the second arm of each rocker and providing the coupling between said rocker and its corresponding frame.

3. A device according to claim 5 or claim 6, wherein the rockers corresponding to the odd-numbered frames are located opposite to intervals formed between the rockers corresponding to the even-numbered frames.

4. Apparatus according to claim 1 wherein said first and second drive means drive said frames downward and said drive mechanism further comprises spring means coupled to said first and second drive means for urging said frames upward.

5. Apparatus according to claim 2 wherein said first and second drive means drive said frames downward and said drive mechanism further comprises spring means couples to aid first and second drive means for urging said frames upward.

6. Apparatus according to claim 1 further comprising antifriction bearings between each rocker and the supporting shaft on which it pivots.

7. Apparatus according to claim 1 wherein the rockers corresponding to odd-numbered frames are spaced at intervals on said first and third shafts, and the rockers corresponding to even-numbered frames are spaced at similar intervals on said second and fourth shafts, the rockers on the first and third shafts being situated adjacent said intervals on said second and fourth shafts.

8. Apparatus according to claim 2 wherein said first connecting means of each drive means comprises a rod, and said rods coupling the shedding mechanism to the rockers pass between the link arms which couple each two consecutive frames to their respective rockers.

9. A device according to claim 11, wherein the rods for connecting the shedding mechanism to the rockers pass between the link-arms which serve to couple two consecutive frames.

10. Apparatus according to claim 7 wherein said first connecting means of each drive means comprises a rod, and said rods coupling the shedding mechanism to the rockers pass between the link arms which couple two consecutive frames to their respective rockers.

11. In a device for actuating the heddle frames positioned and numbered consecutively with odd and even-numbers of a weaving loom including for each frame, two coupled bell-crank rockers mounted each on a respective supporting shaft, each rocker being connected to the corresponding frame by means of a link arm, and one of said two rockers being connected to a shedding mechanism by means of a rod, the improvement wherein said supporting shafts comprise a horizontal row of at least four parallel shafts extending beneath said heddle frames, the first and third of which constitute a first pair of supporting shafts and the second and fourth of which constitute a second pair of supporting shafts, and wherein the coupled bell-crank rockers connected to even-numbered heddle frames are mounted on one of said first and second pairs of supporting shafts, whereas the coupled bell-crank rockers connected to odd-numbered heddle frames are mounted on the other pair of said supporting shafts.

* * * * *